US008967893B2

(12) United States Patent
Matsuya et al.

(10) Patent No.: US 8,967,893 B2
(45) Date of Patent: Mar. 3, 2015

(54) PRINTER WITH CUTTER PROTECTION MECHANISM

(71) Applicant: Fujitsu Component Limited, Tokyo (JP)

(72) Inventors: Tomoyuki Matsuya, Tokyo (JP); Yoshinari Takabatake, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 104 days.

(21) Appl. No.: 13/713,265

(22) Filed: Dec. 13, 2012

(65) Prior Publication Data

US 2013/0164071 A1 Jun. 27, 2013

(30) Foreign Application Priority Data

Dec. 22, 2011 (JP) ..... 2011-282405

(51) Int. Cl.

| | |
|---|---|
| ***B41J 11/70*** | (2006.01) |
| ***B41J 29/13*** | (2006.01) |
| ***B26D 7/22*** | (2006.01) |
| ***B41J 15/04*** | (2006.01) |
| *B26D 7/00* | (2006.01) |

(52) U.S. Cl.

CPC ..... *B41J 11/70* (2013.01); *B41J 15/042* (2013.01); *B26D 7/22* (2013.01); *B41J 29/13* (2013.01); *B26D 2007/005* (2013.01)

USPC ..... 400/621

(58) Field of Classification Search

CPC ..... B26D 7/22; B41J 11/70; B41J 11/66; B41J 11/703

USPC ..... 400/621, 693; 347/157; 358/304

See application file for complete search history.

(56) References Cited

U.S. PATENT DOCUMENTS

| | | | | |
|---|---|---|---|---|
| 7,510,343 | B1 * | 3/2009 | Arrington et al. | 400/621 |
| 2010/0143018 | A1 * | 6/2010 | Kawaguchi | 400/621 |
| 2012/0057918 | A1 * | 3/2012 | Eoka | 400/621 |

FOREIGN PATENT DOCUMENTS

| | | | | |
|---|---|---|---|---|
| JP | 56060164 | A * | 5/1981 | H04N 1/02 |
| JP | 04371442 | A * | 12/1992 | B65H 20/04 |
| JP | 07-164695 | | 6/1995 | |
| JP | 2003127091 | A * | 5/2003 | B26D 1/30 |
| JP | 2003211756 | A * | 7/2003 | B41J 11/70 |

* cited by examiner

*Primary Examiner* — Daniel J Colilla

(74) *Attorney, Agent, or Firm* — IPUSA, PLLC

(57) ABSTRACT

A printer includes a main body case in which a sheet roll is installed, a sheet discharge port from which a printed sheet of paper is discharged, an opening/closing cover that opens and closes with respect to the main body case, a cutter that is attached to the opening/closing cover and configured to cut the printed sheet of paper from the sheet roll, and a cutter protection mechanism configured to move in correspondence with an opening movement or a closing movement of the opening/closing cover. The cutter protection mechanism is configured to expose the cutter at the sheet discharge port when the opening/closing cover is in an open state and conceal the cutter when the opening/closing cover is in a closed state.

4 Claims, 10 Drawing Sheets

PRINTER WITH CUTTER PROTECTION MECHANISM

CROSS-REFERENCE TO RELATED APPLICATIONS

This application is based upon and claims the benefit of priority of the prior Japanese Patent Application No. 2011-282405 filed on Dec. 22, 2011, the entire contents of which are hereby incorporated by reference.

BACKGROUND OF THE INVENTION

1. Field of the Invention

The present invention generally relates to a printer.

2. Description of the Related Art

Typically, a portable type printer, which performs printing on continuous paper (e.g., roll paper), has a paper cutter mounted thereon. The paper cutter is used to cut the continuous paper discharged from the portable type printer. The portable type printer includes a case body for installing the continuous paper therein. The portable type printer also includes an opening/closing cover that opens and closes for loading or replacing the continuous paper. The paper cutter is mounted on either the case body or the opening/closing cover in the vicinity of a sheet discharge port of the portable type printer.

The paper cutter, which is located in the vicinity of the paper discharge port, is exposed when the opening/closing cover is in an open state. This may result in a user being cut by the paper cutter at the time of, for example, loading the continuous paper.

For example, Japanese Laid-Open Patent Publication No. 7-164695 discloses a receipt printer having a shaft that cooperatively moves with an upper cover, in which a cutting blade is prevented from advancing forward by a tip part of the shaft that protrudes in front of the cutting blade when the upper cover is opened.

However, with the receipt printer disclosed in Japanese Laid-Open Patent Publication No. 7-164695, contact or the like may be caused upon the upper lever in a state where the upper cover is open during an operation of, for example, paper replacement. The contact may cause a lock lever to detach from a pin and result in exposure of the cutting blade. By continuing operation in the state where the cutting blade is exposed, the user could be injured by inadvertently touching the cutting blade.

SUMMARY OF THE INVENTION

The present invention may provide a printer that substantially eliminates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a printer particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a printer including a main body case in which a sheet roll is installed, a sheet discharge port from which a printed sheet of paper is discharged, an opening/closing cover that opens and closes with respect to the main body case, a cutter that is attached to the opening/closing cover and configured to cut the printed sheet of paper from the sheet roll, and a cutter protection mechanism configured to move in correspondence with an opening movement or a closing movement of the opening/closing cover, wherein the cutter protection mechanism is configured to expose the cutter at the sheet discharge port when the opening/closing cover is in a closed state and conceal the cutter when the opening/closing cover is in an open state.

Other objects and further features of the present invention will be apparent from the following detailed description when read in conjunction with the accompanying drawings.

DESCRIPTION OF THE PREFERRED EMBODIMENTS

In the following, embodiments of a printer (e.g., thermal printer) of the present invention are described with reference to the accompanying drawings.

Figure 1:
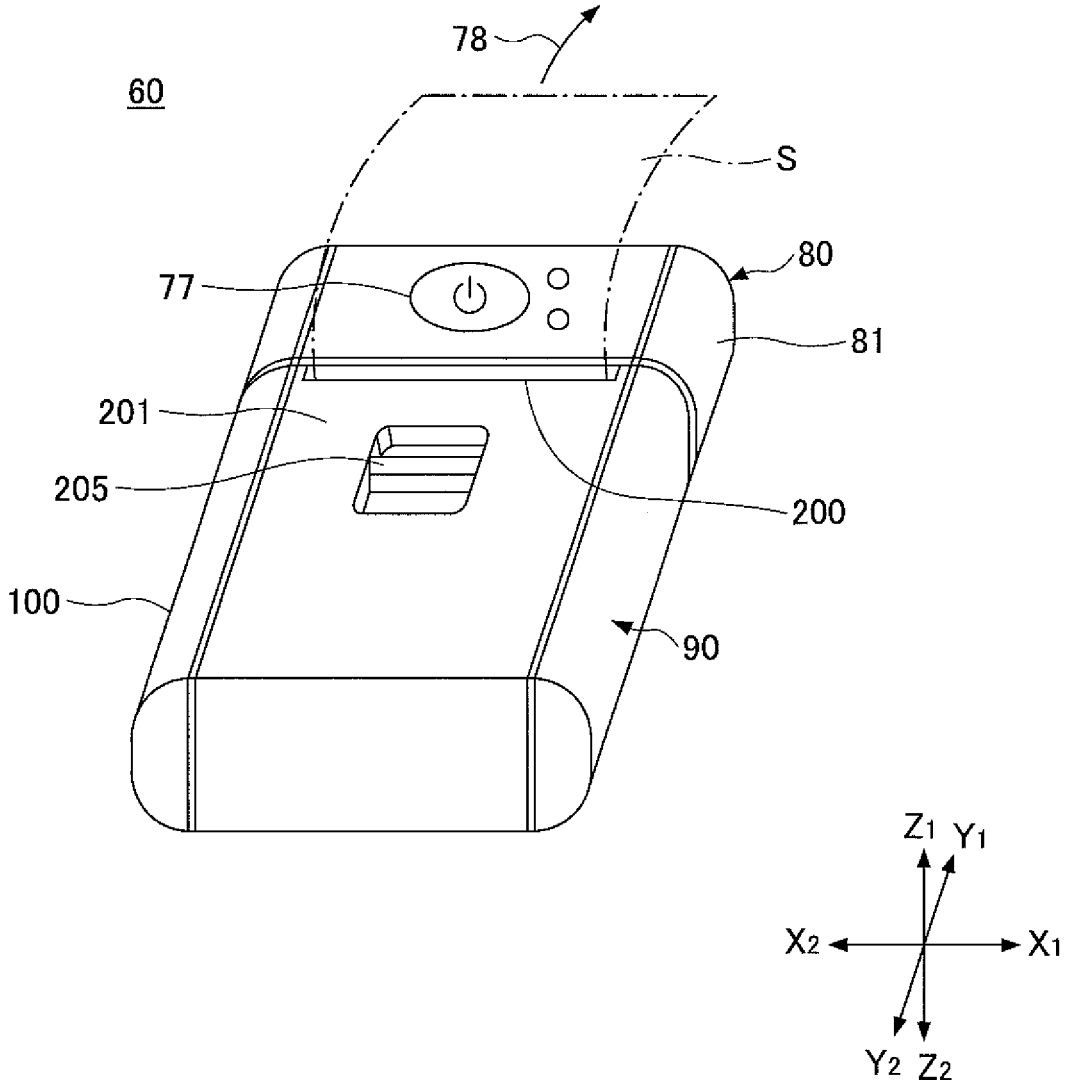
FIG. 1 is a perspective view illustrating a portable type thermal printer according to an embodiment of the present invention.
Figure 2:
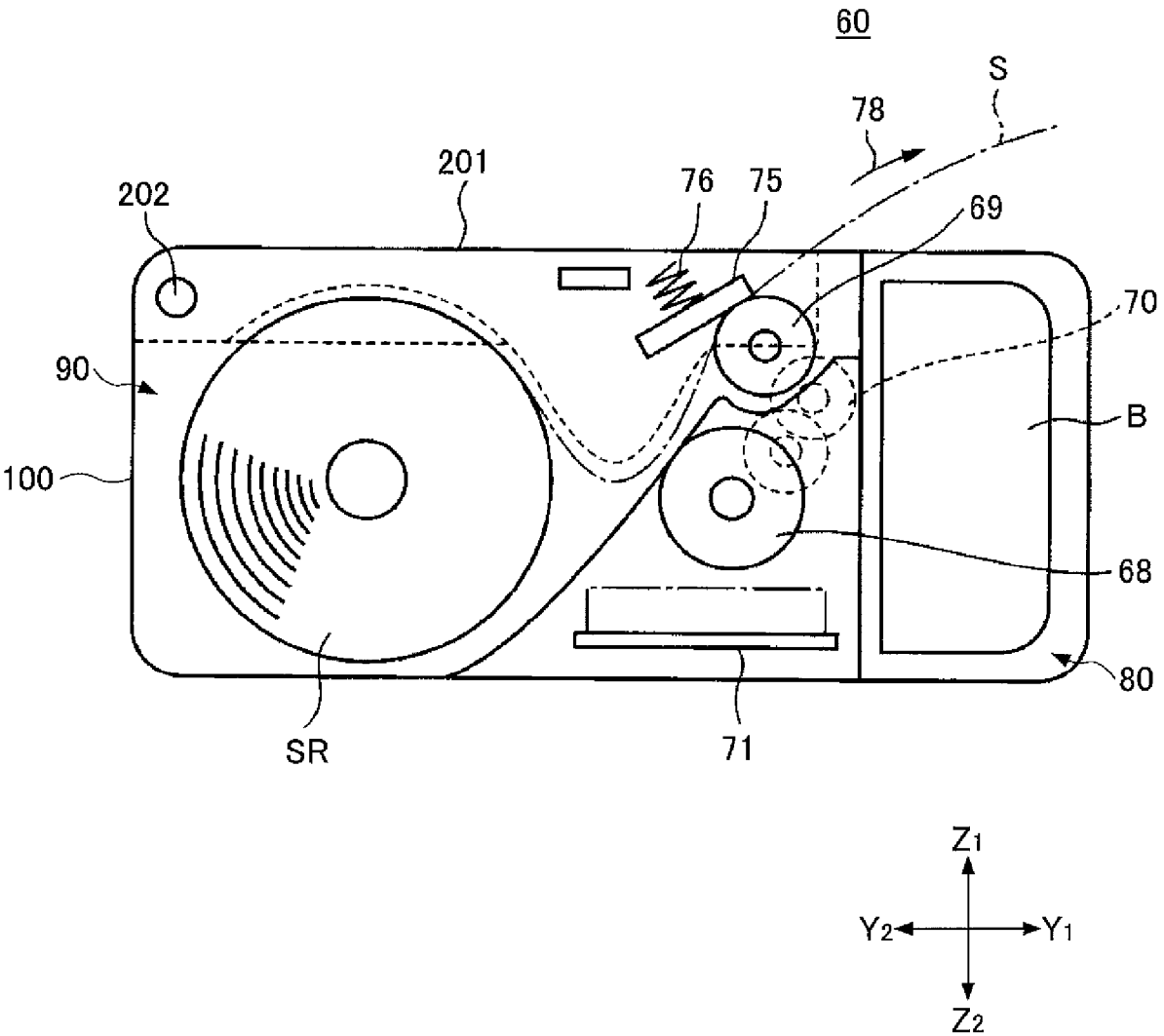
FIG. 2 is a schematic diagram illustrating an internal structure of the portable type thermal printer of FIG. 1.

FIGS. 1 and 2 illustrate a thermal printer 60 according to an embodiment of the present invention. In the drawings, arrows X1-X2 indicate the width direction, arrows Y1-Y2 indicate the depth direction, and arrows Z1-Z2 indicate the height direction of the thermal printer 60 according to an embodiment of the present invention.

The thermal printer 60 includes a main body case 100 having a substantially rectangular parallelepiped shape. A sheet roll installing part 90 for installing a sheet roll SR therein, a conveying mechanism for conveying the sheet roll SR, and a battery installing part 80 for installing a battery B therein are provided inside the main body case 100. The thermal printer 60 is formed in a portable size.

The thermal printer 60, which is a so-called clam shell type printer, also includes an opening/closing cover 201. By opening the opening/closing cover 201, the sheet roller SR can easily be, for example, replaced or removed from the thermal printer 60.

The battery installing part 80 is positioned on the Y1 side of the main body case 100. The sheet roll installing part 90 is positioned on the Y2 side of the main body 100. The battery installing part 80 includes a cover 81. The battery B can be replaced by opening and closing the cover 81.

The main body case 100 also has, for example, a sheet conveying motor 68, a platen roller 69, a gear mechanism 70, and a control circuit board 71 installed therein. The gear mechanism 70 serves to transmit the rotation of the sheet conveying motor 68 to the platen roller 69.

The opening/closing cover 201 is positioned at an upper part of the sheet roller installing part 90. The inside of the sheet roller installing part 90 is exposed by rotating the opening/closing cover 201, in the Z1 direction, around an axle member 202, so that the sheet roller SR can be easily loaded or replaced.

The opening/closing cover 201 includes a thermal head 75 located in a position that contacts the platen roller 69 when the opening/closing cover 201 is in a closed state. A spring 76 urges (i.e. exerts pressure on) the platen roller 69 when the platen roller 69 is in a state contacting the thermal head 75. Further, an operation button 77 and an open/close lever 205 are arranged at an upper part (Z1 direction) of the opening/closing cover 201.

The thermal printer 60 is ready to be used when a sheet S of the sheet roll SR is in a state nipped between the thermal head 75 and the platen roller 69 by installing the battery B in the battery installing part 80, closing the cover 81, installing the sheet roll SR in the sheet installing part 90, pulling out a sheet S of the sheet roll SR, and closing the opening/closing cover 201.

Printing is performed on the sheet S by driving the motor 68 in accordance with commands sent from an external device by way of, for example, wireless, cable, or infrared communication. Accordingly, the motor 68 causes the platen roller 69 to convey the sheet S from the sheet roll R to a predetermined position between the thermal head 75 and the platen roller 69, so that printing can be performed on the sheet S. After letters or the like are printed on a surface of the sheet S, the sheet S is delivered to a sheet discharge port 200 in a direction indicated by an arrow 78 in FIG. 2.

The sheet S discharged from the sheet discharge port 200 is cut off in a direction that substantially perpendicularly intersects the direction in which the sheet S is conveyed (sheet conveying direction). The sheet S is cut off by a cutter 10 (see, for example, FIG. 3) provided in the vicinity of the sheet discharge port 200.

First Embodiment

Figure 3:
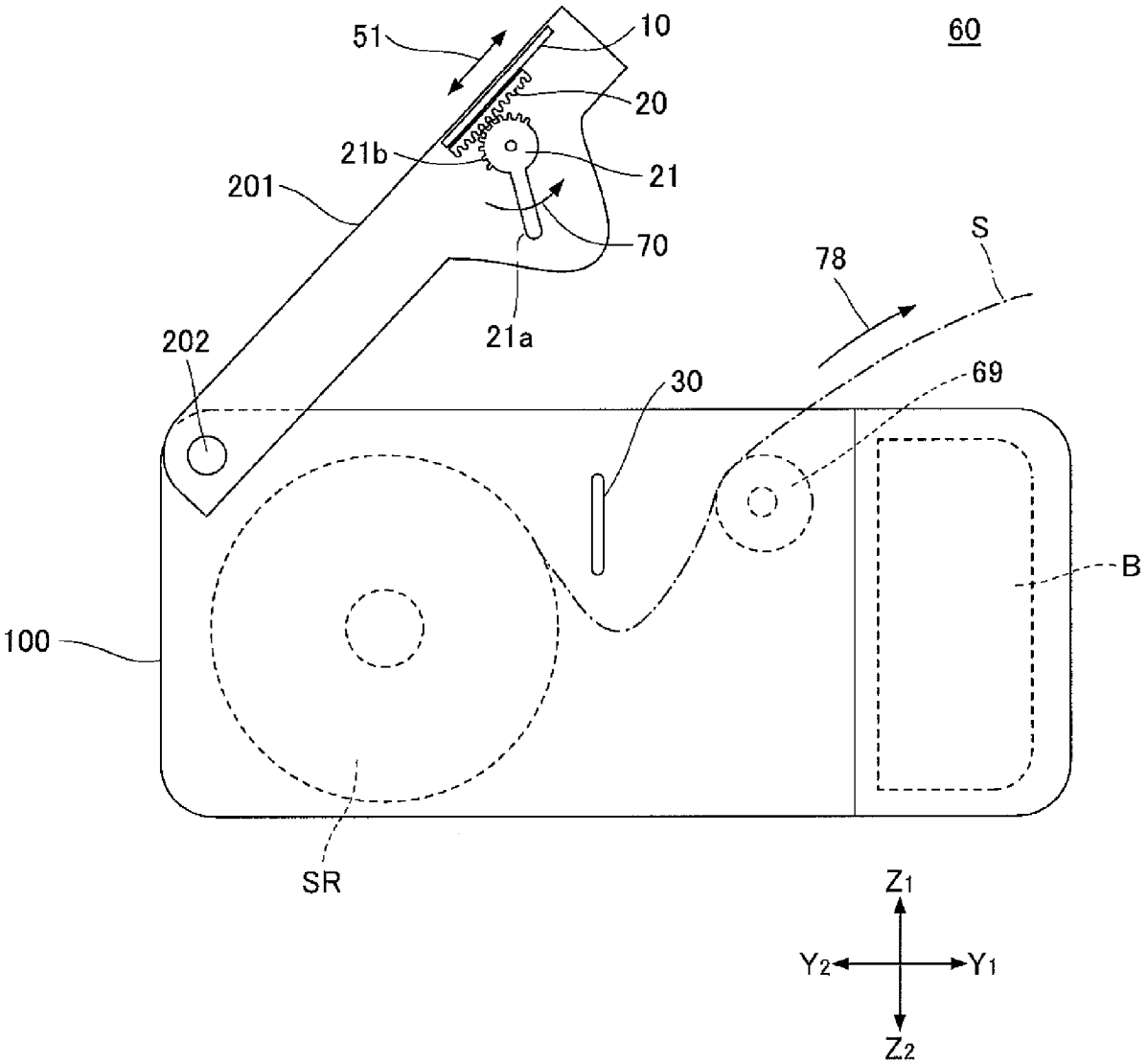
FIG. 3 is a schematic side view illustrating an open state of an opening/closing cover of a thermal printer according to a first embodiment of the present invention.
Figure 4:
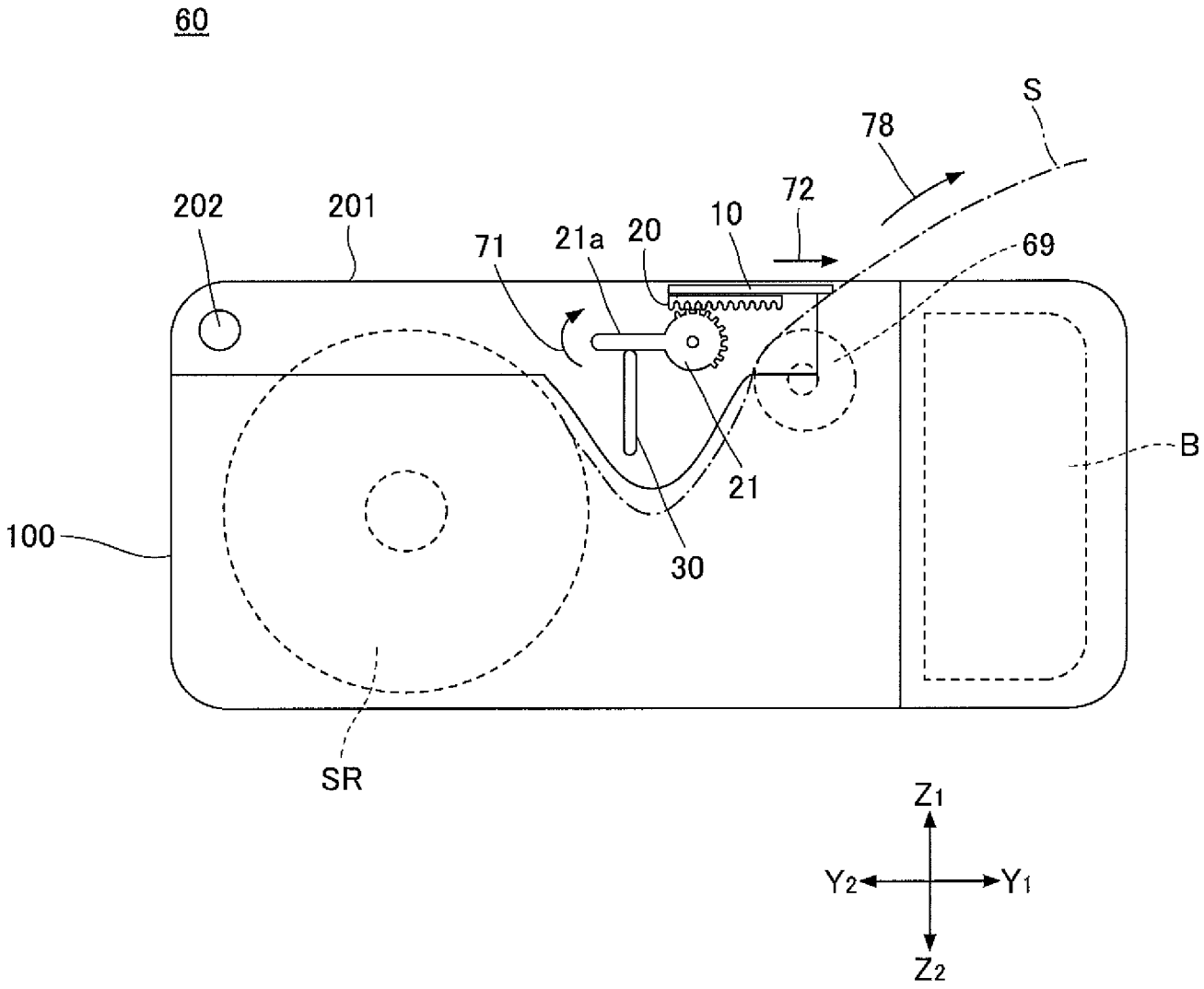
FIG. 4 is a schematic side view illustrating a closed state of an opening/closing cover of a thermal printer according to the first embodiment of the present invention.

FIGS. 3 and 4 illustrate an example of a configuration of the thermal printer 60 according to the first embodiment of the present invention. FIGS. 3 and 4 are for describing movements in the thermal printer 60 during the opening/closing of the opening/closing cover 201. FIG. 3 is a schematic side view of the thermal printer 60 in a state where the opening/closing cover 201 is open. FIG. 4 is a schematic side view of the thermal printer 60 in a state where the opening/closing cover 201 is closed.

The opening/closing cover 201 includes the cutter 10 for cutting the sheet S. The cutter 10 is movable in a direction indicated by an arrow 51 in FIG. 3. A rack gear 20 is attached to an end part of the cutter 10. Further, the opening/closing cover 201 includes a pinion gear 21 which rotates by engaging the rack gear 20 attached to the end part of the cutter 10.

The pinion gear 21 includes a rod part 21*a* and a gear part 21*b*. The rod part 21*a* having a pole-like shape projects from a peripheral surface of the pinion gear 21. The gear part 21*b* is configured to mesh with the rack gear 20. Accordingly, the below-described urging member urges (i.e. exerts pressure on) the pinion gear 21, so that the pinion gear 21 can rotate in a direction indicated by an arrow 70 of FIG. 3. In a state where no pressure is exerted on the pinion gear 21, the pinion gear 21 is configured to move the cutter 10 toward the inside of the opening/closing cover 201 via the rack gear 20.

Figure 10A:
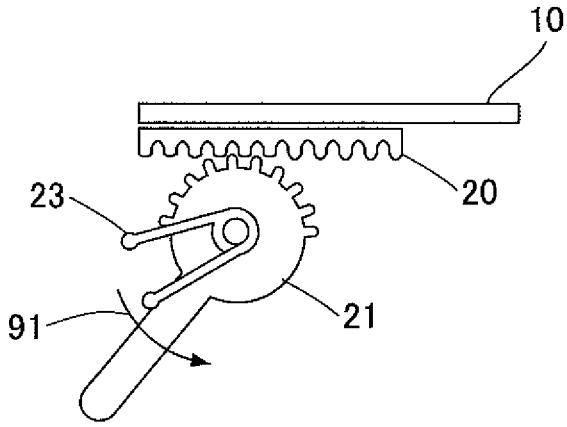
FIGS. 10A-10C are schematic diagrams illustrating a configuration including a pinion gear, a cutter, and an urging part of a holding member according to an embodiment of the present invention.
Figure 10B:
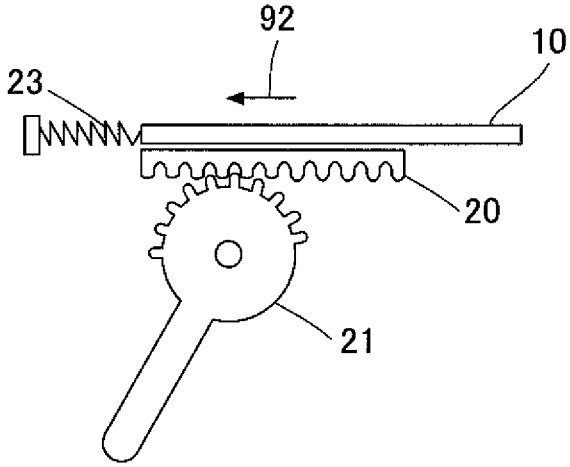

For example, a spring 23 may be used as the urging member for urging (i.e. exerting pressure on) the pinion gear 21. The spring 23 may be positioned in a manner illustrated in FIG. 10A to urge the pinion gear 21 in a direction indicated by an arrow 91. Alternatively, the spring 23 may be positioned in manner illustrated in FIG. 10B to urge the cutter 10 in a direction indicated by an arrow 92 of FIG. 10B.

Further, a rib 30 is arranged in an inner side surface of the main body case 100. The rib 30 is positioned to push the rod part 21*a* upward and rotate the pinion gear 21 when closing the opening/closing cover 201. As illustrated in FIG. 4, the rib 30 contacts the rod part 21*a* when the opening/closing cover 201 is in a closed state. In this closed state, the rib 30 rotates the pinion gear 21 in a direction indicated by an arrow 71 of FIG. 4, so that the cutter 10 is moved in a direction indicated by an arrow 72 by way of the rack gear 20. Thereby, the cutter 10 is exposed at the sheet discharge port 200.

Hence, the cutter 10 can be moved to be installed in the opening/closing cover 201 in a case where the opening/closing cover 201 is in an open state (as illustrated in FIG. 3) by providing a cutter protection mechanism including the rack gear 20, the pinion gear 21, the urging part (e.g., spring 23) of the pinion gear 21, and the rib 30. That is, with the cutter protection mechanism, the cutter 10 can be installed inside the opening/closing cover 201 in a case where the opening/closing cover 201 is in an open state by exerting pressure on the pinion gear 21, so that the pinion gear 21 is rotated in a direction indicated by an arrow 70 of FIG. 3 and the gear part 21*b* and the rack gear 20 are engaged.

In a case where the opening/closing cover 201 is in a closed state, the rib 30 arranged in the main body case 100 pushes the rod part 21*b* of the pinion gear 21 upward and rotates the pinion gear 21 in a direction indicated by an arrow 71 in FIG. 4. The cutter 10, which includes the rack gear 20 that meshes with the pinion gear 21, moves in a direction indicated by an arrow 72 in FIG. 4 in a case where the pinion gear 21 is moved in the direction indicated by the arrow 71 in FIG. 4. Thereby, the cutter 10 is moved from a state installed in the opening/closing cover 201 to a state exposed at the sheet discharge port 200. By exposing the cutter 10 at the sheet discharge port 200 in a case where the opening/closing cover 201 is in a closed state, a sheet S, after having letters or the like printed thereon, can be cut off by pressing the sheet S against the cutter 10.

With the thermal printer 60 according to the first embodiment of the present invention, an operator can be prevented from being cut or injured by contact with the cutter 10 during an operation of loading or replacing a sheet roll SR owing to the cutter 10 installed in the opening/closing cover 201 in a case where the opening/closing cover 201 is in an open state.

Figure 5A:
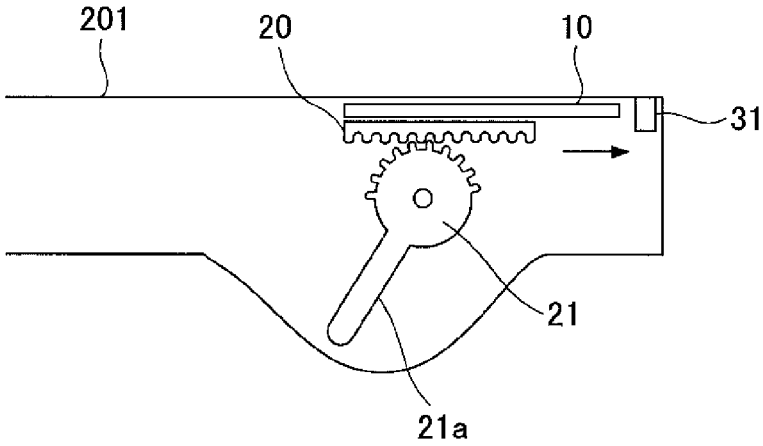
FIGS. 5A and 5B are schematic diagrams illustrating a cleaning member and a polishing member of a thermal printer according to a second embodiment of the present invention.
Figure 5B:
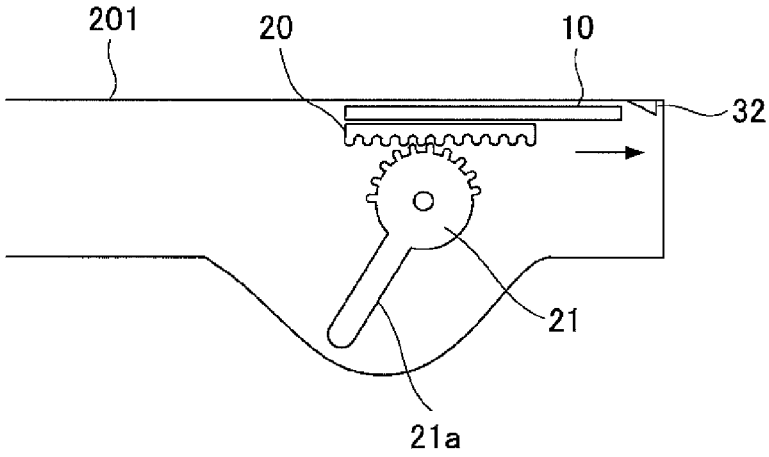

As illustrated in FIGS. 5A and 5B, a cleaning member 31 or a polishing member 32 may be arranged at a position enabling the cutter 10 to move toward and contact the cleaning member 31 or the polishing member 32 when the opening/closing cover 201 is opened or closed. FIG. 5A illustrates an example of a configuration of the thermal printer 60 including the cleaning member 31. FIG. 5B illustrates an example of a configuration of the thermal printer 60 including the polishing member 32.

The cleaning member 31 may be, for example, a sponge made by foaming a synthetic resin such as polyurethane. Paper particles and foreign material adhered to the cutter 10 can be removed when the cutter 10 moves in correspondence with the opening or closing of the opening/closing cover 201.

Accordingly, cutting failure due to foreign matter caught between the sheet S and the cutter 10 can be prevented by providing the cleaning member 31.

Further, the polishing member 32 may be, for example, an abrasive grinding wheel that polishes the blade of the cutter 10 whenever the cutter 10 moves. Accordingly, the cutter 10 can maintain a state similar to a brand new state. Thus, the life span of the cutter 10 can be prevented from being shortened due to wear of the blade of the cutter 10.

Further, by providing both the cleaning member 31 and the polishing member 32 in the thermal printer 60, the above-described effects attained by cleaning member 31 and the polishing member 32 can attained at the same time.

Second Embodiment

Figure 6:
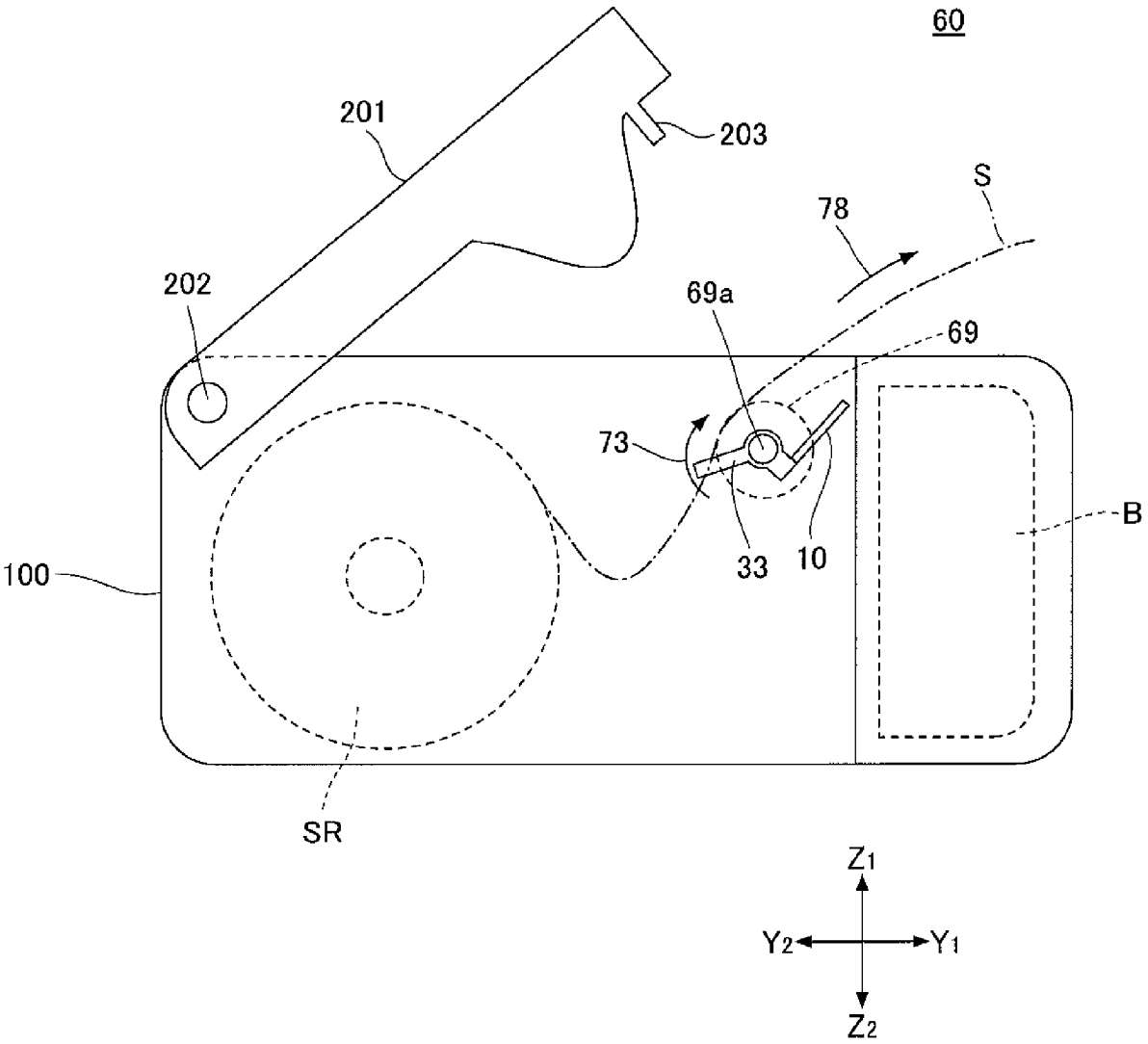
FIG. 6 is a schematic side view illustrating an open state of an opening/closing cover of a thermal printer according to the second embodiment of the present invention.
Figure 7:
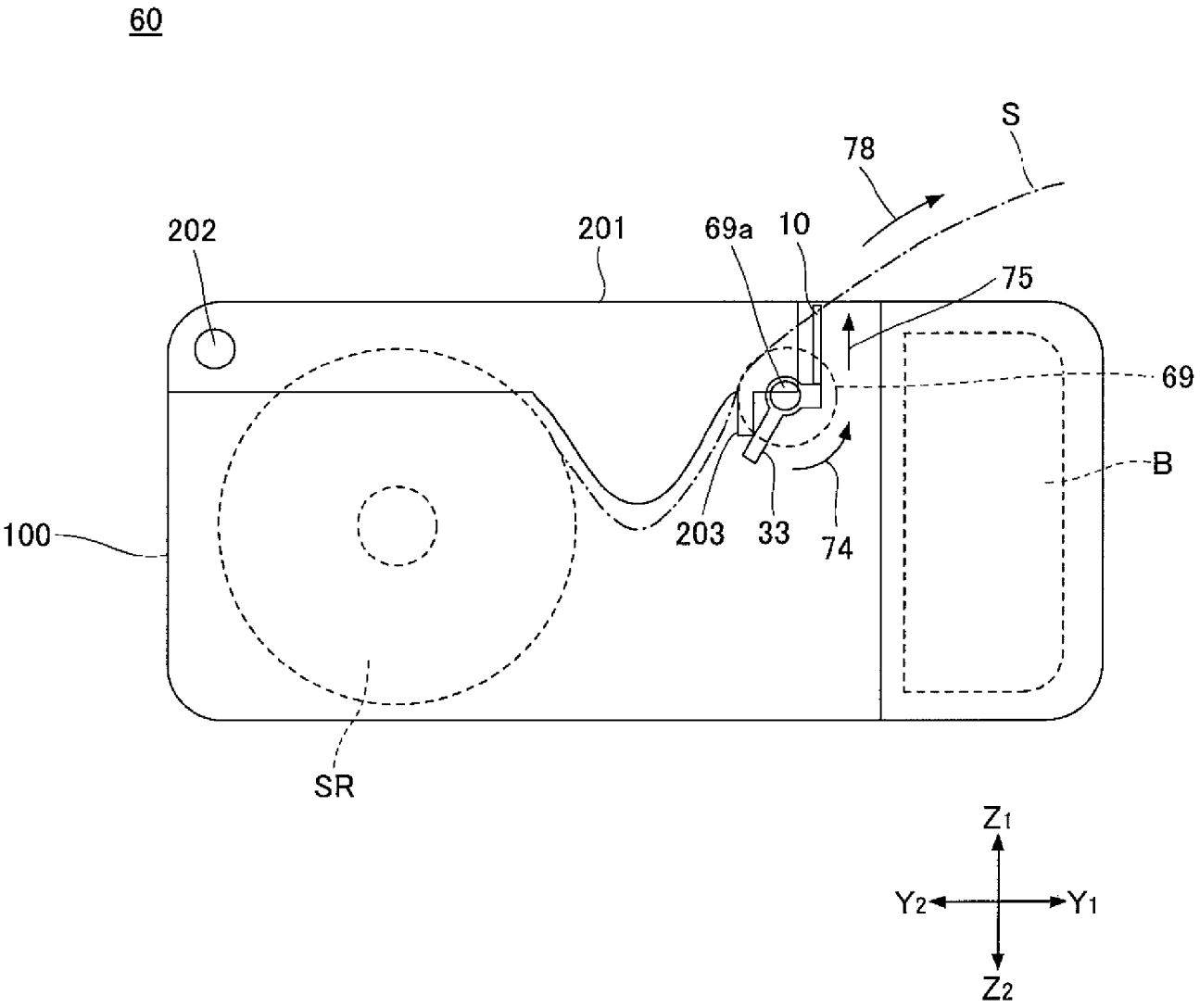
FIG. 7 is a schematic side view illustrating a closed state of an opening/closing cover of a thermal printer according to the second embodiment of the present invention.

FIGS. 6 and 7 illustrate an example of a configuration of the thermal printer 60 according to the second embodiment of the present invention. FIGS. 6 and 7 are for describing movements in the thermal printer 60 during the opening/closing of the opening/closing cover 201. In the second embodiment, like components are denoted by like reference numerals as those of the first embodiment and are not further explained.

Figure 10C:
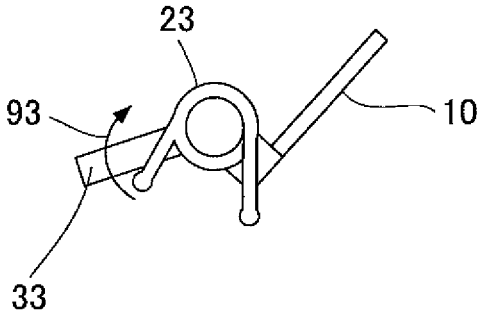

The main body case 100 includes a retaining member 33 which retains the cutter 10. The retaining member 33 is rotatably supported by a shaft 69*a* of the platen roller 69 of the main body case 100. A spring or the like urges the retaining member 33 in a direction indicated by an arrow 73 of FIG. 6. In a state where the opening/closing cover 201 is in an open state as illustrated in FIG. 6, the retaining member 33 is urged to rotate in a direction indicated by the arrow 73, so that the cutter 10 is rotated and installed in the main body case 100. For example, the spring 23 illustrated in FIG. 100 may be used as an urging member for urging the retaining member 33. The spring 23 may be arranged to urge the retaining member 33 in a direction indicated by an arrow 93 of FIG. 10C.

The opening/closing cover 201 includes a projecting part 203 formed in a position at which the projecting part 230 contacts the retaining member 33 and rotates the retaining member 33. In a case where the opening/closing cover 201 is in a closed state as illustrated in FIG. 7, the projecting part 203 of the opening/closing cover 201 depresses the retaining member 33 and rotates the retaining member 33 in a direction indicated by an arrow 74. Thereby, the cutter 10, being retained by the retaining member 33, is exposed at the sheet discharge port 200.

Hence, the cutter 10 can be moved to be installed in the opening/closing cover 201 in a case where the opening/closing cover 201 is in an open state by providing a cutter protection mechanism including the projecting part 203 of the opening/closing cover 201, the retaining member 33 (which retains the cutter 10 and is rotatably supported by, for example, the shaft of the platen roller 69), and the urging member 23 (which urges the retaining member 33). Therefore, even in a case of loading or replacing the sheet roll SR, the operator can be prevented from being cut by the cutter 10.

Third Embodiment

Figure 8:
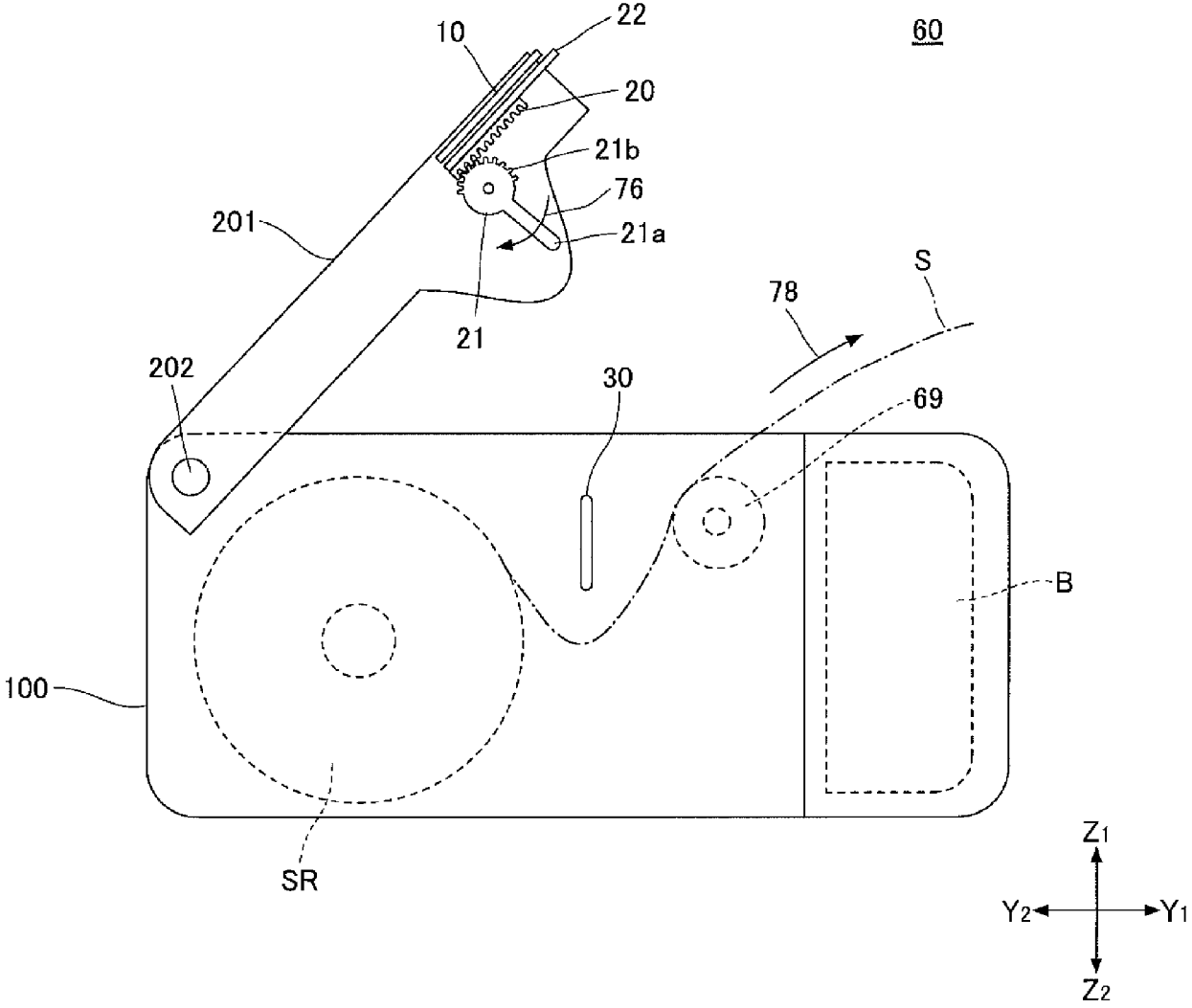
FIG. 8 is a schematic side view illustrating an open state of an opening/closing cover of a thermal printer according to a third embodiment of the present invention.
Figure 9:
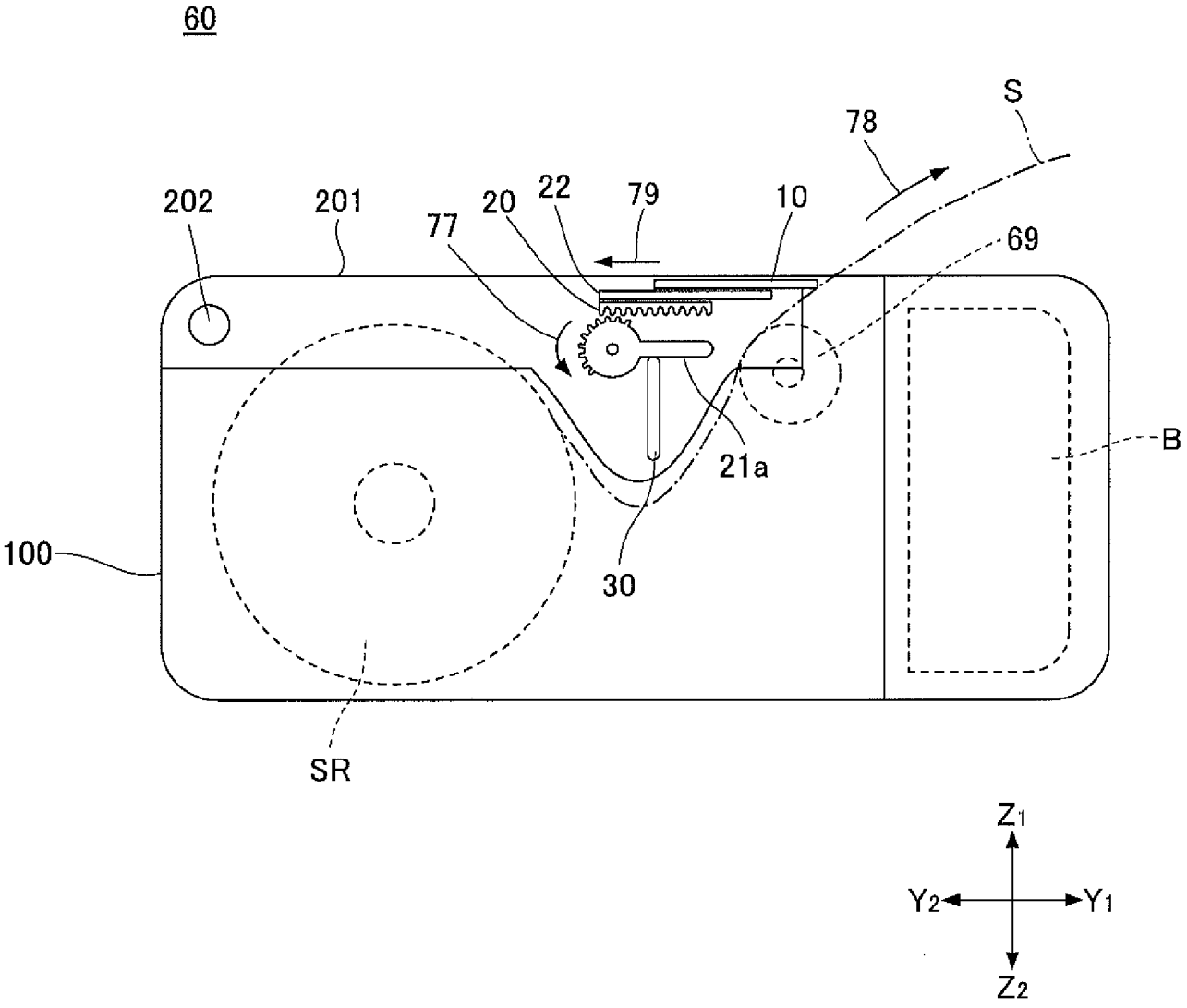
FIG. 9 is a schematic side view illustrating a closed state of an opening/closing cover of a thermal printer according to the third embodiment of the present invention.

FIGS. 8 and 9 illustrate an example of a configuration of the thermal printer 60 according to the third embodiment of the present invention. FIGS. 8 and 9 are for describing movements in the thermal printer 60 during the opening/closing of the opening/closing cover 201. In the third embodiment, like components are denoted by like reference numerals as those of the first embodiment and are not further explained.

The cutter 10 is fixed to the opening/closing cover 201, so that the cutter 10 is in a position exposed at the sheet discharge port 200. That is, the cutter 10 is attached to the opening/closing cover 201 in a manner that the cutter 10 is unable to move. The opening/closing cover 201 includes a shutter 22 that can move in positions exposing and covering the cutter 10.

The rack gear 20 is arranged at an end part of the shutter 22. The rack gear 20 meshes with the pinion gear 21 that is rotatably supported by a shaft or the like. The pinion gear 21 is urged in a direction indicated by an arrow 76 of FIG. 8 by an urging member. The pinion gear 21 includes a rod part 21*a* projecting from a peripheral surface of the pinion gear 21 and a gear part 21*b*. By urging the pinion gear 21 in a direction indicated by an arrow 76 of FIG. 9, the shutter 22 is moved to a position covering the cutter 10 in a state where the opening/closing cover 201 is open.

Similar to the first embodiment, a spring 23 or the like may be used as the urging part that urges the pinion gear 21. Accordingly, the spring 23 may urge the pinion gear 21 in a direction indicated by the arrow 76 of FIG. 8, so that the pinion gear 21 causes the shutter 22 to move toward a position covering the cutter 10.

Further, the rib 30 is arranged in an inner side surface of the main body case 100. The rib 30 is positioned to push the rod part 21*a* upward and rotate the pinion gear 21 when closing the opening/closing cover 201. As illustrated in FIG. 9, the rib 30 contacts the rod part 21*a* when the opening/closing cover 201 is in a closed state. In this closed state, the rib 30 rotates the pinion gear 21 in a direction indicated by an arrow 77 of FIG. 9, so that the shutter 22 is moved in a direction indicated by an arrow 79 by way of the rack gear 20. Thereby, the cutter 10 is exposed at the sheet discharge port 200.

Hence, the shutter 22 can be moved to cover the cutter 10 in a case where the opening/closing cover 201 is in an open state (as illustrated in FIG. 8) and moved to expose the cutter 10 at the sheet discharge port 200 in a case where the opening/closing cover 201 is in a closed state (as illustrated in FIG. 9) by providing a cutter protection mechanism including the shutter 22, the rack gear 20, the pinion gear 21, the urging part (e.g., spring 23) of the pinion gear 21, and the rib 30.

Therefore, even in a case of loading or replacing the sheet roll SR, the operator can be prevented from being cut by the cutter 10 owing to the cutter 10 covered by the shutter 22 in a state where the opening/closing cover 201 is open.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A printer comprising:

a main body case in which a sheet roll is installed;

a sheet discharge port from which a printed sheet of paper is discharged;

an opening/closing cover that opens and closes with respect to the main body case;

a cutter that is attached to the opening/closing cover and configured to cut the printed sheet of paper from the sheet roll; and a cutter protection mechanism configured to move in correspondence with an opening movement or a closing movement of the opening/closing cover;

wherein the cutter protection mechanism is configured to expose the cutter at the sheet discharge port when the opening/closing cover is in a closed state and conceal the cutter when the opening/closing cover is in an open state, wherein the cutter protection mechanism includes a rack gear that is fixed to an end part of the cutter, a pinion gear configured to mesh with the rack gear and rotate relative to the rack gear, an urging part that urges the cutter or the pinion gear in a direction causing the cutter to be installed in the opening/closing cover, and a rib that is formed on an inner side surface of the main body case, wherein the pinion gear includes a rod part projecting from a peripheral surface of the pinion gear, wherein the rib is configured to rotate the pinion gear by exerting pressure on the rod part during the closing movement of the opening/closing cover and move the cutter to a position exposed at the sheet discharge port.

2. The printer as claimed in claim 1, wherein the cutter is movably attached to the opening/closing cover, wherein the cutter protection mechanism is configured to move the cutter.

3. The printer as claimed in claim 2, further comprising:

a cleaning member configured to clean the cutter and contact the cutter that is moved by the cutter protection mechanism.

4. The printer as claimed in claim 2, further comprising:

a polishing member configured to polish the cutter and contact the cutter that is moved by the cutter protection mechanism.

* * * * *